US007523873B1

(12) United States Patent
Lopes

(10) Patent No.: US 7,523,873 B1
(45) Date of Patent: Apr. 28, 2009

(54) HEATING SYSTEM

(76) Inventor: Walter R. Lopes, 90 Kilmer Ave., Taunton, MA (US) 02780

( * ) Notice: Subject to any disclaimer, the term of this patent is extended or adjusted under 35 U.S.C. 154(b) by 992 days.

(21) Appl. No.: 10/980,287

(22) Filed: Nov. 4, 2004

(51) Int. Cl.
*B60H 1/02* (2006.01)

(52) U.S. Cl. ..... 237/12.3 B; 237/19; 237/70

(58) Field of Classification Search ..... 237/12.3 B, 237/19, 70; 123/142.5 R; 122/26; 126/247
See application file for complete search history.

(56) References Cited

U.S. PATENT DOCUMENTS 797,847 A 8/1905 Gilroy
823,856 A 6/1906 Gilroy
2,764,147 A * 9/1956 Brunner ..... 126/247
3,813,036 A * 5/1974 Lutz ..... 237/2 R
4,060,194 A * 11/1977 Lutz ..... 237/1 SL
4,143,639 A * 3/1979 Frenette ..... 126/247
4,342,422 A * 8/1982 Davis ..... 237/19
4,344,567 A 8/1982 Horne et al.
4,352,455 A * 10/1982 Moser et al. ..... 237/12.3 R
4,370,956 A * 2/1983 Moser et al. ..... 123/196 AB
4,407,449 A * 10/1983 Moser et al. ..... 237/12.3 R
4,412,651 A * 11/1983 Webster, Jr. ..... 237/1 R
4,420,114 A * 12/1983 Moser et al. ..... 237/1 R
4,434,934 A * 3/1984 Moser et al. ..... 237/12.3 R
4,462,386 A 7/1984 Powell
4,481,934 A * 11/1984 Stephenson ..... 126/247
4,646,714 A * 3/1987 Bolin ..... 126/247
4,728,029 A * 3/1988 Griebel et al. ..... 237/12.3 R
5,392,737 A 2/1995 Newman, Sr. et al.
5,979,435 A * 11/1999 Puett, Jr. ..... 126/247

* cited by examiner

*Primary Examiner*—Derek S Boles
(74) *Attorney, Agent, or Firm*—John P. McGonagle

(57) ABSTRACT

A closed heating system drawing external power from a small electric generator. The heating system contains a hydraulic fluid drawn through restrictors and pumped through a heat transfer means attached to a means for circulating a heated fluid through a household.

4 Claims, 2 Drawing Sheets

HEATING SYSTEM

BACKGROUND OF THE INVENTION

This invention relates to household heating systems, and in particular, to a friction heater for use as a household heating system.

Household heating systems are based on the use of electricity, gas, oil or coal to heat air. Household heating systems fall generally into one of two major categories. Heat may be generated through the use of hot water flowing through dispersed radiators and wall board radiators or through the use of hot air dispersed through conduits from a central hot air plenum. Regardless of the heating system used, the cost of electricity, gas, oil or coal is substantial and has been generally rising through the years.

It would be desirable to have a low cost heating system to provide household heating. Such a low cost heating system could act as a supplement to a main household heating system thereby eliminating the need for running a main household heating system during the summer months as well portions of the spring and fall months. The low cost heating system could also replace a traditional main household heating system in its entirety.

SUMMARY OF THE INVENTION

The present invention provides a low-cost heating system using friction heating. A friction heater is based on the principle of forcing a liquid through a restrictor so as to obtain frictionally generated heat. The heating system of the present invention is a closed heating system drawing external power from a small electric generator. This heating system contains a hydraulic fluid drawn through restrictors and pumped through a heat transfer means attached to the main household heating system.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
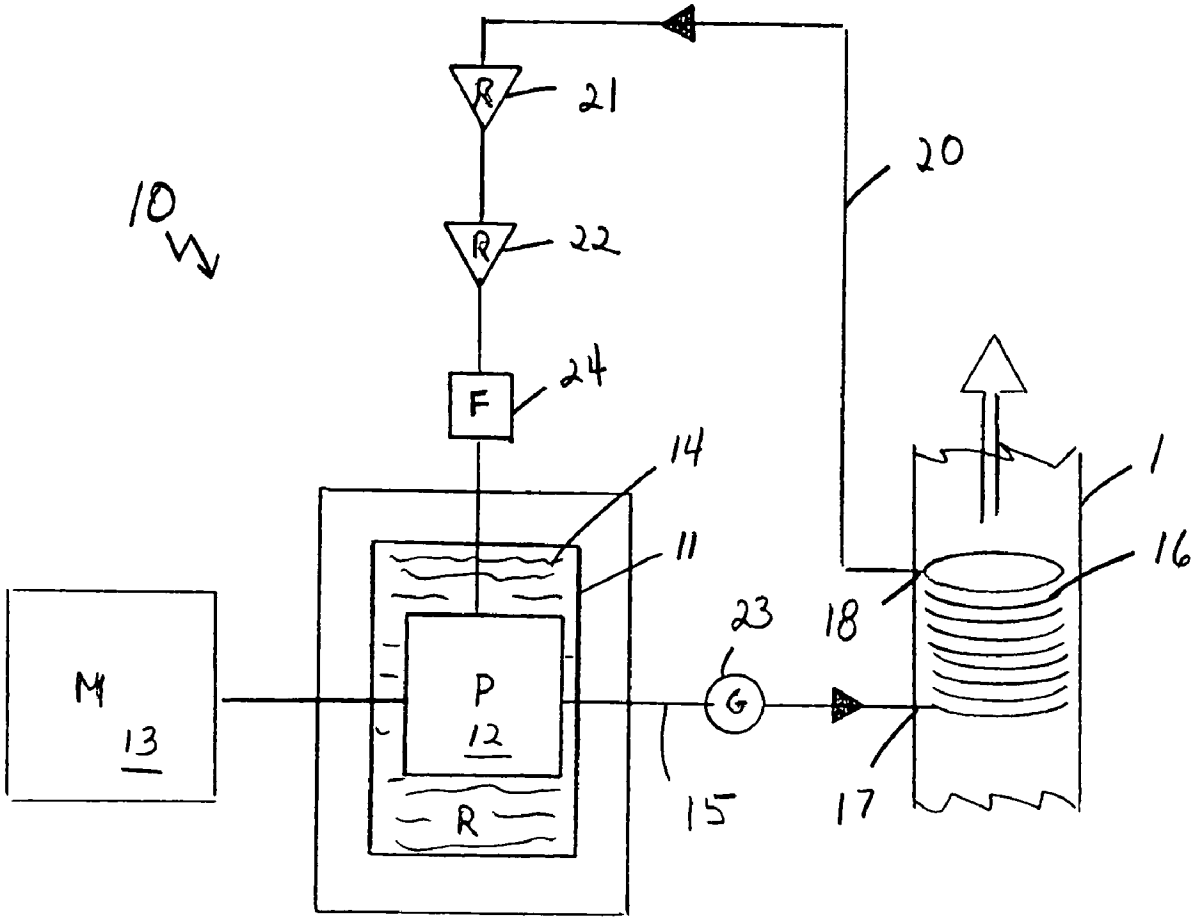
FIG. 1 is a block diagram of a supplemental heating system of the invention.
Figure 4:
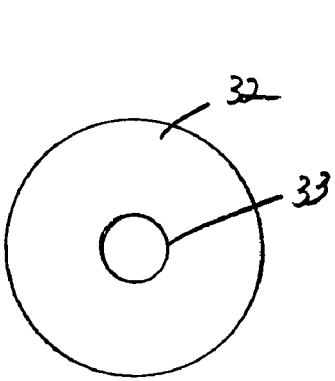
FIG. 4 is a view of the exit end of the restrictor element of FIGS. 2 and 3.
Figure 3:
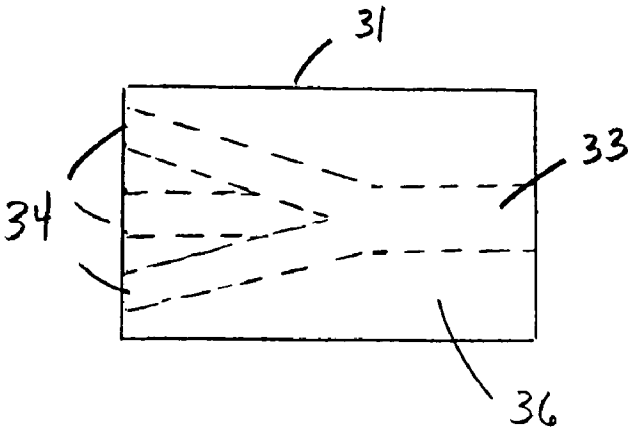
FIG. 3 is a side view of the restrictor element of FIG. 2.
Figure 2:
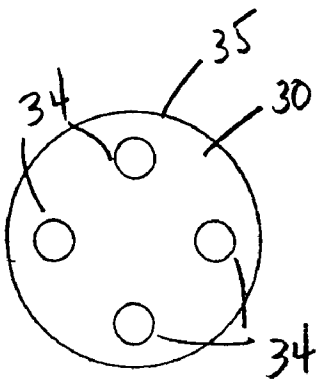
FIG. 2 is a view of the entry end of a restrictor element of the invention.

Referring to the drawings in detail wherein like elements are indicated by like numerals, there is shown in FIG. 1 a block diagram of a heating system 10 constructed according to the present invention. The heating system 10 is a closed system and is comprised of reservoir tank 11 with a pump 12 located therein. The reservoir tank 11 is filled with approximately one and one-half gallons of hydraulic fluid 14. The pump 12 is driven by an electric motor 13 external to the tank 11. The pump 12 pumps hydraulic fluid 14 out of the tank 11 under pressure through a distribution line 15. The distribution line 15 is connected to an entry end 17 of a tubular coil 16 and feeds the hydraulic fluid 14 into the entry end 17 and through the tubular coil 16 to a tubular coil exit end 18. The tubular coil exit end 18 is connected to a system return line 20. The return line 20 is connected to a first restrictor 21 and then to a second restrictor 22. The pump 12 draws the hydraulic fluid from the tubular coil exit end 18, into the return line 20, through the first restrictor 21 and through the second restrictor 22 back into the reservoir tank 11.

A pressure regulator 23 is installed in the distribution line 15 before the tubular coil entry end 17. A one quart filter 24 may optionally be installed in the return line 20, between the second restrictor 22 and the reservoir tank 11.

In this embodiment of the invention, the tubular coil 16 acts as a heat exchanger and is positioned in a forced hot air plenum 1 of a main household heating system. In other embodiments, a heat exchanger equivalent to the tubular coil could be installed in a hot water heating system. Essentially, the heat exchanger provides a heat transfer means attached to a means for circulating a heated fluid through a household. In this embodiment of the invention, heat from the tubular coil 16 heats air moving through the plenum 1 and circulating through the household. As heat is lost from the hydraulic fluid 14 flowing through the tubular coil 16, the pressure of the hydraulic fluid drops. As the spent hydraulic fluid is drawn into the return line 20 it encounters a first restrictor 21. Pressure is thereby increased on the hydraulic fluid. The hydraulic fluid then encounters a second restrictor 22. Pressure on the hydraulic fluid is further increased. If a filter 24 is used, further restricting is experienced by the hydraulic fluid, with an additional pressure increase.

The pressurized hydraulic fluid is drawn from the return line 20 into the reservoir tank 11. The pump 12 is a brass transfer pump, sitting in the reservoir tank 11 and submerged under the hydraulic fluid. By using two mechanical restrictors 21, 22 the pressure build up on the hydraulic fluid is increased and a lower energy motor 13 may be used in the system 10. In this embodiment of the invention, the motor 13 is a three horse power, single phase motor. Any heat from the submerged pump 12 adds to the heat of the hydraulic fluid within the reservoir tank 11. The heated and pressurized hydraulic fluid 14 is pumped into the distribution line 15. The pressure regulator 23 controls hydraulic fluid pressure and therefore the system heat. In this embodiment of the invention, the distribution line 15 and return line 20 have a one inch diameter.

The restrictors 21 and 22 are identical and are positioned about eighteen inches apart in the return line 20. Each said restrictor has an entry end 30 from which a cylindrical side wall 31 extends to an exit end 32, each said restrictor being generally cylindrical in shape, the longitudinal axis of each said restrictor being defined by said entry end 30 and said exit end 32. The entry end 30, exit end 32 and side wall 31 define a generally solid restrictor interior 36. The restrictor entry end 30 is defined as that part of the restrictor in which the returning hydraulic fluid first enters the restrictor. The restrictor exit end 32 is defined as that part of the restrictor from which the restricted hydraulic fluid exits. In this embodiment of the invention, each restrictor side wall 31 has a one and one eighth inch external diameter and each restrictor is 1.680 inches in length from end 30 to end 32.

Each restrictor exit end 32 has an open central aperture 33 extending a predetermined distance toward the entry end 30. The exit end open central aperture 33 has a diameter of five sixteenths of an inch. Each restrictor entry end 30 has four apertures 34 formed therein, said apertures 34 being equally positioned radially about a center and near to an entry end perimeter 35. The entry end apertures 34 extend to and join together at the exit end central aperture 33 within said restrictor interior 36. Each entry end aperture 34 has a diameter of 0.165 inches. By making the restrictors longer, pressure and temperature of the hydraulic fluid passing through a restrictor may be increased.

It is understood that the above-described embodiment is merely illustrative of the application. Other embodiments may be readily devised by those skilled in the art which will embody the principles of the invention and fall within the spirit and scope thereof.

I claim:

1. A closed heating system comprising:

a reservoir tank filled with hydraulic fluid;

a pump located in said reservoir tank, said pump being driven by a motor external to the reservoir tank, said pump adapted to pump said hydraulic fluid under pressure out of said reservoir tank;

a distribution line attached to said reservoir tank, said distribution line adapted to receive said hydraulic fluid under pressure out of said reservoir tank;

a heat exchanger with an entry end and an exit end, said heat exchanger entry end interconnected to said distribution line, said heat exchanger entry end adapted to receive said hydraulic fluid and pass said hydraulic fluid through to said heat exchanger exit end;

a system return line connected to said heat exchanger exit end;

a first restrictor having an entry end and an exit end, said first restrictor entry end interconnected to said system return line;

a second restrictor having an entry end and an exit end, said second restrictor entry end interconnected to said first restrictor exit end, said second restrictor exit end attached to said reservoir tank;

wherein each said restrictor entry end being defined as that part of the restrictor in which the returning hydraulic fluid first enters the restrictor, each said restrictor exit end being defined as that part of the restrictor from which the restricted hydraulic fluid exits;

wherein said pump is adapted to draw the hydraulic fluid from the heat exchanger exit end, into the return line, through the first restrictor, through the second restrictor and back into the reservoir tank;

wherein said heat exchanger provides a heat transfer means attached to a means for circulating a heated fluid through a household;

wherein, said first and second restrictors are identical, each said restrictor having a cylindrical side wall extending from said entry end to said exit end, each said restrictor being generally cylindrical in shape, the longitudinal axis of each said restrictor being defined by said entry end and said exit end, each said entry end, exit end and side wall defining a generally solid restrictor interior, each said restrictor exit end having an open central aperture extending a predetermined distance toward the entry end, each said restrictor entry end having four apertures formed therein, said apertures being equally positioned radially about a center and near to an entry end perimeter, said entry end apertures extending to and join together at the exit end central aperture within said restrictor interior.

2. A closed heating system as recited in claim 1, wherein:

said restrictors are positioned approximately eighteen inches apart in the return line.

3. A closed heating system as recited in claim 1, wherein:

each restrictor side wall has a one and one eighth inch external diameter length from entry end to exit end of 1.680 inches.

4. A closed heating system as recited in claim 3, wherein:

each restrictor exit end open central aperture has a diameter of five sixteenths inches; and each entry end aperture has a diameter of 0.165 inches.

* * * * *